US006200499B1

(12) United States Patent
Kalota et al.

(10) Patent No.: US 6,200,499 B1
(45) **Date of Patent: *Mar. 13, 2001**

(54) COMPOSITIONS FOR CORROSION INHIBITION OF FERROUS METALS

(75) Inventors: Dennis J. Kalota, Fenton; David C. Silverman, Chesterfield, both of MO (US)

(73) Assignee: Solutia Inc., St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/483,904

(22) Filed: Jun. 7, 1995

Related U.S. Application Data

(63) Continuation-in-part of application No. 08/092,932, filed on Jul. 19, 1993, now abandoned, which is a continuation-in-part of application No. 07/475,506, filed on Feb. 6, 1990, now abandoned.

(51) Int. Cl.[7] ..... C09K 3/00; C23F 11/04

(52) U.S. Cl. ..... 252/389.62; 252/389.61; 252/390; 252/392; 422/7; 422/16

(58) Field of Search ..... 252/390, 392, 252/394, 389.61, 389.62; 422/7, 16

(56) References Cited

U.S. PATENT DOCUMENTS

| | | | | |
|---|---|---|---|---|
| 1,797,402 | * | 3/1931 | Calcott | 252/389.62 X |
| 1,810,946 | * | 6/1931 | Calcott | 252/389.62 X |
| 2,368,604 | * | 1/1945 | White | 252/51.5 R |
| 2,870,201 | * | 1/1959 | Pollack | 562/553 X |
| 2,944,968 | | 7/1960 | Hutchison | 252/8.55 |
| 3,639,292 | * | 2/1972 | Gilby | 252/179 |
| 3,655,351 | * | 4/1972 | Jamieson | 252/392 X |
| 3,712,918 | * | 1/1973 | Dudzinski | 252/392 X |
| 3,859,337 | * | 1/1975 | Herz et al. | 562/623 |
| 3,932,605 | * | 1/1976 | Vit | 424/53 |
| 3,954,858 | * | 5/1976 | Lamberti et al. | 562/583 |
| 4,204,841 | * | 5/1980 | Biasotti et al. | 252/392 X |
| 4,238,348 | * | 12/1980 | Larsen et al. | 252/391 |
| 4,238,350 | * | 12/1980 | Larsen et al. | 252/392 |
| 4,479,917 | | 10/1984 | Rothgery et al. | 422/16 |
| 4,517,241 | * | 5/1985 | Alpert | 428/332 |
| 4,868,287 | * | 9/1989 | Sikes et al. | 530/324 |
| 4,898,684 | * | 2/1990 | Chen et al. | 252/181 |
| 4,971,724 | * | 11/1990 | Kalota et al. | 252/390 |
| 5,093,020 | * | 3/1992 | Paul et al. | 252/82 |

FOREIGN PATENT DOCUMENTS

| | | | |
|---|---|---|---|
| 501063 | * | 3/1954 | (CA) . |
| 2100264A | * | 12/1982 | (GB) . |
| 2100264 | | 12/1982 | (GB) . |
| 91546 | | 7/1975 | (JP) . |

OTHER PUBLICATIONS

Chemical Abstracts, vol. 84, No. 2, Jul. 22, 1975, p. 8214, Abstract No. 8215d, Aizawa, Yuji et al., "Corrosion Inhibitor for Metals".*

Hluchan et al, "Amino Acids As Corrosion Inhibitors in Hydrochloric Acid Solutions," *Werkstoffe und Korrosion*, 39, 512–517 (1988).

Ramakrishnaiah, "Role of Some Biologically Important Compounds on the Corrosion of Mild Steel and Copper in Sodium Chloride Solutions", *Bulletin of Electrochemisty*, 2(1), 7–10 (1986).

* cited by examiner

*Primary Examiner*—Richard D. Lovering
(74) *Attorney, Agent, or Firm*—Gordon F. Sieckmann; Thompson Coburn LLP

(57) ABSTRACT

Compositions comprising certain amino acids such as aspartic acid, when fully ionized at alkaline pH, function effectively as corrosion inhibitors for ferrous metals in the presence of an aqueous medium. This effect is enhanced with increased fluid velocity.

18 Claims, 4 Drawing Sheets

MILD STEEL/ASPARTIC ACID/PH 10 - 90°C - 200RPM - 22 - 24 HR

MILD STEEL/DEIONIZED WATER/PH 10 - 200RPM - 90°C - 22 - 24 HR

MILD STEEL/PH 10 WITH AND WITHOUT ASPARTIC ACID -200RPM - 90°C

MILD STEEL/PH 10 WITH AND WITHOUT ASPARTIC ACID - 200RPM - 90°C

COMPOSITIONS FOR CORROSION INHIBITION OF FERROUS METALS

This is a Continuation In Part of Application Ser. No. 08/092,932, filed Jul. 19, 1993 and now abandoned, which is a Continuation In Part of Application Ser. No. 07/475,506, filed Feb. 6, 1990, now abandoned.

BACKGROUND OF THE INVENTION

1. Field of the Invention

The present invention relates to new and improved corrosion inhibiting compositions, an unexpected and new use of biodegradable corrosion inhibitors, for inhibiting corrosion of ferrous metal surfaces (susceptible to corrosion) in the presence of an aqueous medium. More particularly, this invention relates to corrosion inhibiting amino acids effective to inhibit corrosion of ferrous metals under use conditions in the presence of an otherwise corrosive aqueous medium.

2. Description of the Related Art

An important mechanism for protecting the metal against corrosive deterioration is achieved through the use of inhibitors. Unfortunately, certain common corrosion inhibitors such as nitrogen- and aromatic compound-containing formulations, used widely as additives for inhibiting corrosion in aqueous heating and cooling systems, have been found to be hazardous to public health and to the surrounding environment. Removal of such hazardous compounds by precipitation or other treatments is complicated and expensive. Other corrosion inhibitors, such as chromatic salts have been banned from use because they are suspected carcinogens. Consequently, it has become desirable to examine the inhibition properties of biologically compatible and/or biodegradable compounds. Such compounds, if nontoxic, easy to produce in high purities, and biodegradable, can dramatically ease the chore of removal or recycling. Amino acids have been proposed for limited use.

For example, Nippon Kokoh, in Japanese Patent J50091546-A, Jul. 22, 1975, disclosed that mixtures requiring both amines and amino acids or their salts, when dissolved in water to form 20% aqueous solutions, inhibited atmospheric corrosion of various ferrous and non-ferrous metal sheets. The pH of the moisture absorbed on the sheets is believed to have been approximately 5.5 or less, based on the known relationship of water condensation in contact with carbon dioxide ($CO_2$). See, for example, Whitman et al., Industrial and Engineering Chemistry, 16(7), 655–670 (1924); and Hurlen et al., Journal of Electroanalytical Chemistry, 180, 511–526 (1984).

However, more extensive studies on common amino acids alone have not proven promising. For example, in V. Hluchan et al, "Amino Acids As Corrosion Inhibitors in Hydrochloric Acid Solutions," Warkstoffe und Korrosion, 39, 512–517 (1988) 22 of the most common amino acids were investigated as inhibitors for the corrosion of iron in 1.0 M hydrochloric acid, at pH or about 0. Generally, those having inhibiting characteristics at acid pH did not demonstrate corrosion inhibition efficiencies effective for immediate industrial use. The longer hydrocarbon chain amino acids and those having additional amino groups, or groups which could increase electron density on the amino groups, demonstrated the only tendency toward effective corrosion inhibition.

Notably, aspartic acid, the preferred amino acid for use in the present invention, and glutamic acid did not come within the scope of the "tendency". The conclusion was that such amino acids are particularly poor inhibitors because of the single amino group, the short carbon chain and the additional carboxyl group.

Moreover, it is considered a drawback by those skilled in the art to employ aspartic acid as an inhibitor at above acid pH conditions because aspartic acid is known to be inherently corrosive at slightly alkaline pH conditions. See K. Ramakrishnaiah, "Role of Some Biologically Important Compounds on the Corrosion of Mild Steel and Copper in Sodium Chloride Solutions", Bulletin of Electrochemistry, 2(1), 7–10 (1986). Therein, it was disclosed that aspartic acid at a pH of 8 actually accelerated corrosion (inhibition efficiency of −25.4%). In fact, even when combined with an excellent corrosion inhibitor for mild steel such as papaverine, the presence of aspartic acid maintained the solution's corrosiveness.

An associated problem in the industry is that fluid movement is known to increase the rate of corrosion for ferrous metals when exposed to an aqueous environment. Accordingly, whatever corrosive effect which might be anticipated from amino acids such as aspartic acid in aqueous media would be expected to worsen, as a practical matter, if such amino acids were present in automotive, cooling, or heating devices where such media would be set in motion.

Therefore, amino acids such as aspartic acid, although nontoxic and biodegradable, have been avoided as corrosion inhibitors.

A process for inhibition of corrosion of ferrous metals by using amino acids having only a single amino group, and having an additional carboxyl group (such as aspartic acid) under conditions wherein each such suitable amino acid is present in its fully ionized conjugate base state would represent a surprisingly unexpected discovery while satisfying a long-felt need in the industry. Likewise, a corrosion inhibitor for ferrous metals which would decrease the rate of corrosion, even under increased aqueous fluid movement conditions, would represent a substantial improvement in the art.

SUMMARY OF THE INVENTION

It is the principal object of the present invention to provide new and improved corrosion inhibiting compositions for inhibiting the corrosion of ferrous metals in the presence of an aqueous medium.

It is another primary object of the present invention to provide new and improved corrosion inhibiting compositions for inhibiting the corrosion of ferrous metals in the presence of an aqueous medium under static conditions.

Still another primary object of the present invention to provide new and improved corrosion inhibiting compositions for inhibiting the corrosion of ferrous metals in the presence of an aqueous medium under dynamic fluid movement conditions.

It is a further object of the present invention to provide, as corrosion inhibitors for ferrous metals in the presence of an aqueous medium, new and improved corrosion inhibiting compositions comprising at least one corrosion inhibiting amino acid existing in a fully ionized conjugate base state, such amino acids having a single amino group.

Other and further objects of the present invention will become apparent from the accompanying description and claims.

It has been found that certain amino acids, particularly aspartic acid, previously known to accelerate corrosion of metals in mildly alkaline aqueous media, unexpectedly function effectively as corrosion inhibitors for ferrous metals when such amino acids are present in their corresponding fully ionized conjugate base state. In such state, such amino acids provide a 100 to 1000 fold decrease in the corrosion rate of ferrous metals. Surprisingly, this corrosion inhibiting effect improves with increased fluid velocity.

DESCRIPTION OF THE PREFERRED EMBODIMENTS

Figure 1:
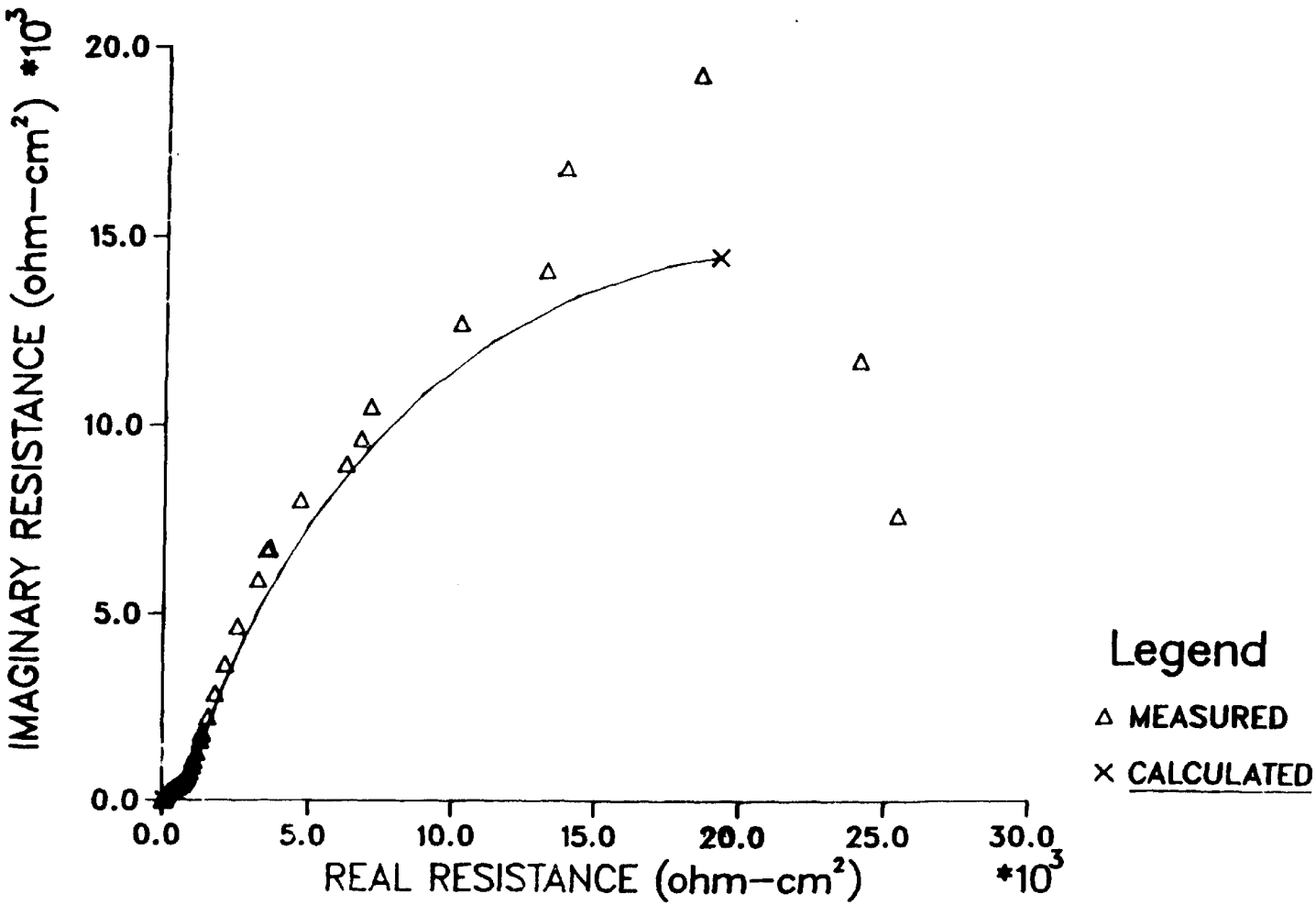
FIG. 1 shows a plot of the impedance spectrum in real versus imaginary coordinates for a mild steel electrode rotating at 200 rpm in an aqueous solution at 90° C. containing 1000 ppm aspartic acid at a pH of 10.
Figure 2:
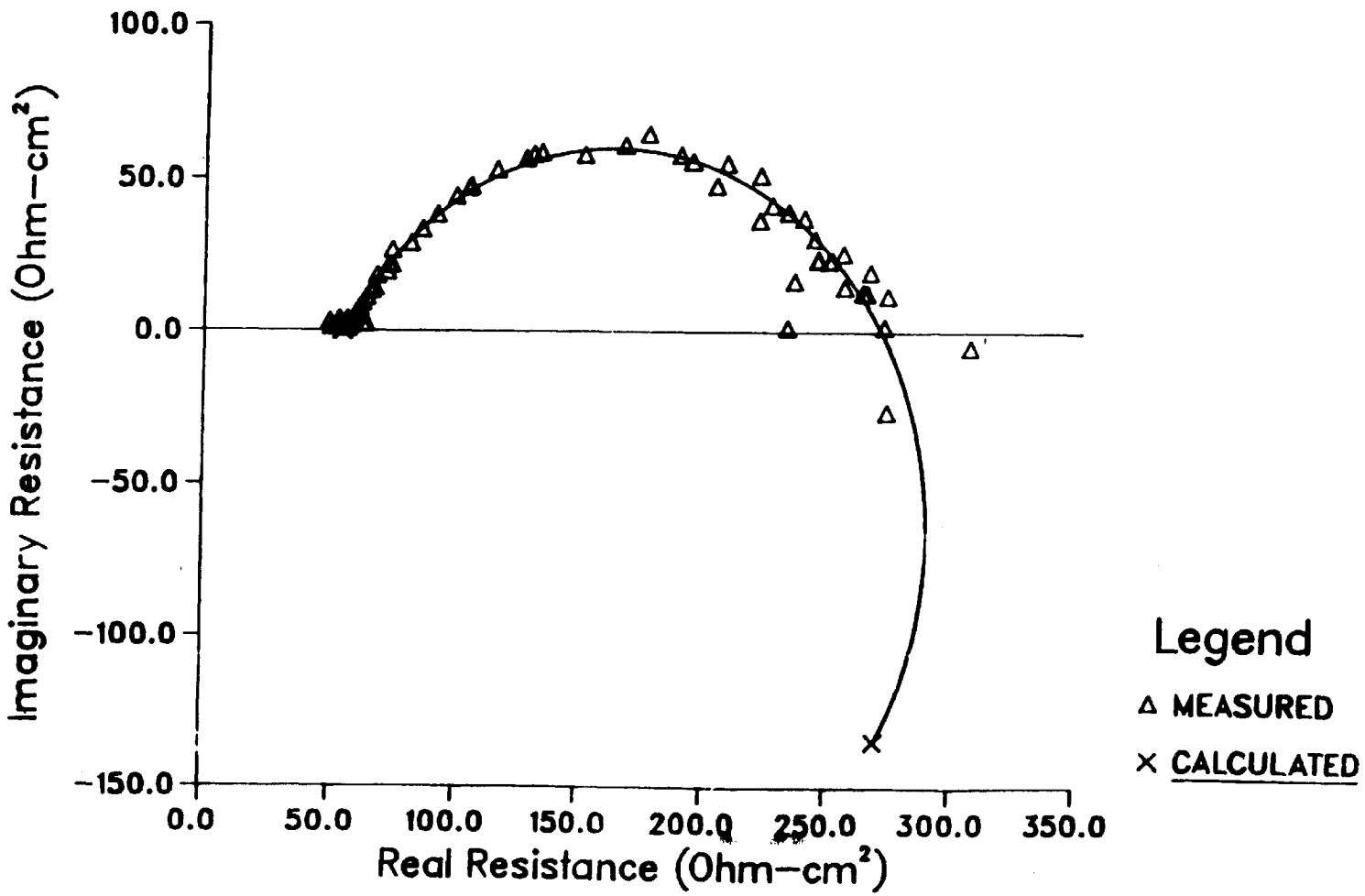
FIG. 2 shows a plot of the impedance spectrum in real versus imaginary coordinates for a mild steel electrode rotating at 200 rpm in an aqueous solution at 90° C. at a pH of 10 without aspartic acid, but with conductivity adjusted with sodium sulfate.
Figure 3:
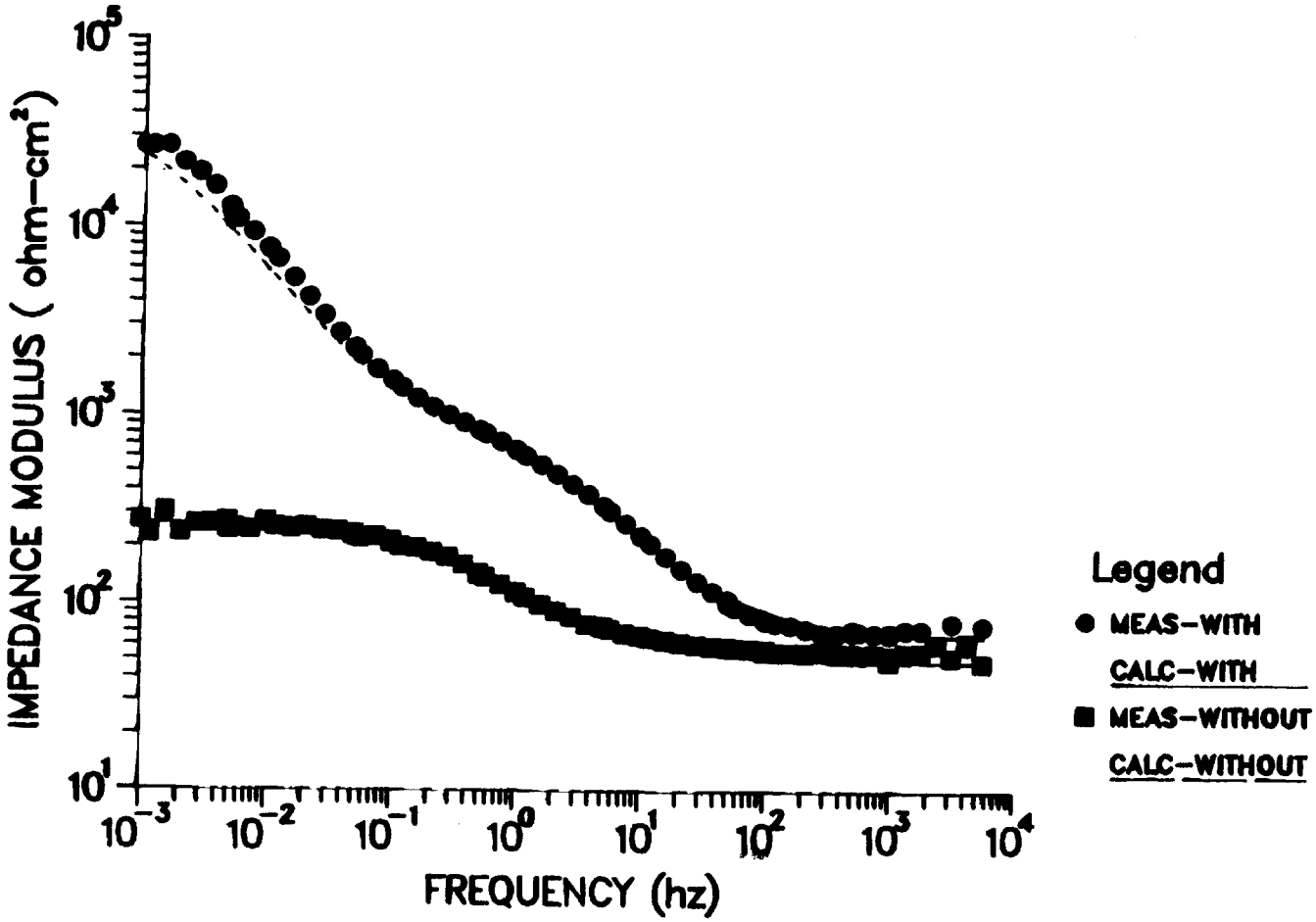
FIG. 3 shows a plot of the impedance magnitude versus logarithm of frequency for the mild steel electrode in FIGS. 1 and 2.

Useful in the present invention are amino acids having a single amino group and salts thereof. Preferably, these compounds have an excess of carboxyl groups over "free" amino groups, for example, two carboxyl groups and one amino group, although a carboxyl group/amino group ratio of 1 is suitable. Suitable amino acids are represented by the following formula:

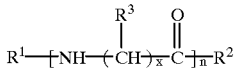

wherein $R^1$ represents

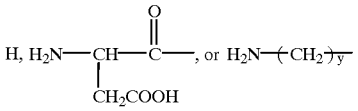

$R^2$ represents

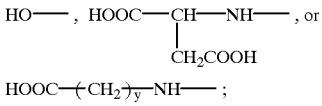

$R^3$ represents —H, —COOH, —$CH_2$COOH, or —$CH_2CH_2$COOH x and y each independently represents an integer from 1 to 3; and n represents an integer for the number of repeating aminoacyl units.

Illustrative of suitable compounds are glycine, polyglycine, aspartic acid, polyaspartic acid, glutamic acid, polyglutamic acid, and salts thereof. Nonlimiting suitable salts include, for example, alkali metal, soluble alkaline earth metal, and $C_1$–$C_4$ alkylamine salts.

These compounds are readily available from a number of sources and can be manufactured either by chemical synthesis or microbial fermentation. The molecular weight (M.W.) for polymers of the monomeric amino acids in general ranges from about 1000 to about 100,000, with a peak average M.W. from about 8,000 to about 10,2000 (typical peak average M.W. of about 9200), as determined using a poly(ethylene glycol) standard. Typically, for polyaspartic acid, this results in an n value of about 78 for the typical peak average M.W. of the polymeric material, thereby providing an n value ranging from 1 for (monomeric) aspartic acid to about 850 for polyaspartic acid exhibiting a M.W. having an upper limit of about 100,000.

Such amino acid compounds tend to be ineffective as corrosion inhibitors when in the fully protonated cationic state, and become even worse by actually accelerating corrosion as the pH rises from acidic to alkaline.

It is recognized, of course, that in aqueous media, the amino acid exists in equilibrium with its conjugate base (amino acid anion). And as the pH increases, the dissociation equilibrium point will shift toward the conjugate base state such that the amino acid exists in increasing amounts in the ionized state. Finally, at a threshold pH value, the amino acid will exist substantially in the ionized state. This phenomenon is characterized herein as the fully ionized conjugate base state.

It now has been found surprisingly and unexpectedly that when such amino acid compounds are present as their corresponding fully ionized conjugate base state, they dramatically reverse the corrosion rate of ferrous metals. In general, an alkaline pH value of at least about 8.9, depending upon the temperature and the specific amino acid compound employed, is suitable. Under such conditions, the corrosion rate is reduced 100 to 1000 fold when compared with the rate of corrosion of ferrous metals under comparable pH conditions in the absence of such amino acids (existing in their corresponding fully ionized conjugate base state).

The corrosion inhibitors of the present invention may be employed (in the aqueous medium) at concentrations as low as 100 parts per million to as high as 5.0 weight percent and above. It is particularly preferred to utilize the corrosion inhibitors of the present invention at a concentration of from about 1000 ppm to about 3.3 weight percent. It is understood, however, that concentrations greater than 5.0 weight percent of the corrosion inhibitors can be utilized, if desired, so long as the higher amounts are not detrimental to the system in which the corrosion inhibitors are employed.

The corrosion inhibiting effect of the compositions of the present invention can be found at temperatures as low as room temperature or about 25° C. or below and as high as about 90° C. and above.

Although temperature is known to accelerate the corrosion of metals, it is particularly noted that an increase in temperature does not affect the corrosion inhibiting properties of the present invention beyond whatever effect temperature has on the pH. For example, the pH of the system may decrease by 1 unit from the value measured at 25° C., compared to that measured at 90° C. The pK of the conjugate base of the amino acid in a fully ionized state also will decrease with an increase in temperature. However, so long as the temperature does not cause the pH to decrease below the point at which the amino acid exists in its fully ionized conjugate base state, the compositions of the present invention will remain effective.

In a particularly preferred embodiment, the compositions of the present invention are employed in dynamic, flowing systems. Surprisingly, the corrosion rate of ferrous metals in such systems does not increase with increasing fluid velocity. In fact, there tends to be a significant decrease in the corrosion rate with an increase in fluid velocity. Normally, in the absence of the compositions of the present invention, an increase in fluid velocity from, for example, 200 revolutions per minute (rpm) to about 1000 rpm in a rotating cylinder electrode results in an increase in the corrosion rate of ferrous metals in the presence of such an aqueous medium during a period of at least 24 hours. This increase in corrosion rate occurs commonly for steels in water and other aqueous systems because the reduction of oxygen is often the rate limiting step. That is, the rate of mass transfer of oxygen to the corroding surface increases with increasing fluid velocity.

The pH of the aqueous medium under use conditions for the corrosion inhibiting compositions of the present invention may vary from about 8.9 to about 14, preferably from about 9.5 to about 12, more preferably from about 9.9 to about 12, and most preferably from about 10 to about 11, as measured at ambient or room temperatures (about 25° C.). It is particularly preferred to use the compositions of the present invention at a pH of about 10 or greater, as measured at ambient or room temperatures. It is understood, however, as previously noted, that the pH will vary, depending upon the temperature at which it is measured.

Therefore, where an aqueous medium is inherently acidic, one preferred embodiment of the present invention is to employ a suitable amino acid, preferably aspartic acid or poly aspartic acid, in the present of a base to raise the overall pH of the aqueous medium to at least 8.9, preferably above about 9.5, most preferably above about 9.9–10, at which pH the amino acid exists in its fully ionized conjugate base state.

The pH of the aqueous medium may be adjusted by addition of any suitable base such as an alkali metal hydroxide, for example, sodium hydroxide and potassium hydroxide. Additional bases which may be employed in this invention include alkali metal carbonates, hydrocarbylamines, alkaline earth metal hydroxides, and ammonium hydroxides.

The pH of a corrosive environment may be inherently alkaline, such as, for example, aqueous solutions in contact with lime deposits, concrete, and fertilizer, and automotive antifreeze solutions. In such systems, corrosion inhibition may be effected by merely adding a suitable amino acid or salt thereof in an amount sufficient to provide in the aqueous medium the concentrations previously described, without having to add extraneous bases.

It is within the scope of the present invention that the corrosion inhibitors may also be used in aqueous media which contain various inorganic and/or organic materials, particularly all ingredients or substances used by the water-treating industry, the automotive industry, and others such as with antifreeze compositions, metal cleaning compositions, and radiator flush compositions.

The effectiveness of corrosion inhibition for metal surfaces is commonly determined by measurement of the rate of corrosion of the subject metal under specified conditions. Two modes of measurement of corrosion rate were employed herein. For convenience, these may be referred to as (1) the standard metal coupon mass loss test, also referred to as static immersion test, and (2) electrochemical impedance technique.

In the standard metal coupon mass loss test mode, metal coupons of known mass are immersed in an aqueous solution whose corrosion inhibiting properties are to be determined. The aqueous media is maintained at a specified set of conditions for a specified period of time. At the conclusion of the exposure period, the coupons are removed from the aqueous solution, cleaned in an ultrasonic bath with soap solution, rinsed with deionized water, rinsed with acetone, patted dry with a lint-free paper towel, blown with a stream of nitrogen, and weighed to determine mass loss and examined under a stereoscope at suitable magnification to determine penetration of the metal surface due to corrosion.

Corrosion, however, is an electrochemical process rather than a strictly chemical reaction. Electrochemical techniques, for example, the electrochemical impedance technique, therefore, provide a useful and convenient indication of corrosion rate. In the electrochemical impedance technique, it is helpful to visualize that a corroding metal surface is comprised of a large number of local anodes and a large number of local cathodes whose sites may actually shift or be at the same location as the corrosion reaction ensues. At the anodic site, the metal is being oxidized, while at the cathodic site reduction is occurring, reduction of hydrogen ions in acidic solutions. The magnitude of the current, in amperes per centimeter squared ($A/cm^2$), at the open circuit potential, as measured relative to a reference electrode, is a measure of the tendency for the respective reaction to proceed. This corrosion current density is referred to as the "corrosion rate". In many instances, corrosion rate is converted to "penetration rate" of corrosion, in mils per year (mpy), or mass loss, by assuming, for example, two electrons per ionized iron atom.

The "electrochemical impedance technique" is applied wherein the frequency at an electrode interface is varied, using a small voltage amplitude wave of, for example, 5 to 10 millivolts (mV). The response is used to estimate the corrosion rate and to draw some conclusions about the corrosion mechanism. Analysis of the impedance spectra provides a term called the "polarization resistance", measured in ohm-centimeter squared (ohm-$cm^2$), which is inversely proportional to the corrosion current density (corrosion rate). Accordingly, the corrosion rate, in accordance with Ohm's law ($I=V/R_p$), equals proportionality factor (for the subject metal), measured in volts, divided by the polarization resistance. For example, a common proportionality factor for carbon steels is 0.025 volts. And since the polarization resistance is inversely proportional to the corrosion rate, relative degrees of polarization resistance are used to determine the degree to which various compositions will either have lower or higher corrosion rates. Thus a polarization resistance of 100 ohm-$cm^2$ is created by a corrosion rate that is about 100 times faster than a corrosion rate having a polarization resistance of 10,000 ohm-$cm^2$. A polarization resistance of 100 ohm-$cm^2$ represents a corrosion rate on the order of about 100 mpy, while that of 1000 ohm-$cm^2$ represents corrosion rate on the order of about 10 mpy. Conversion of polarization resistance to corrosion rate (as mpy) can be made by assuming a proportionality constant of 25 mV and Faraday's law.

For a primer on the electrochemical impedance technique, see D. C. Silverman, "Primer on the AC Impedance Technique," in Electrochemical Techniques for Corrosion Engineering (R. Baboian, ed.), National Association of Corrosion Engineers, Houston, 1986, pp. 73–79.

The following specific examples illustrating the best currently-known method of practicing this invention are described in detail in order to facilitate a clear understanding of the invention. It should be understood, however, that the detailed expositions of the application of the inventions, while indicating preferred embodiments, are given by way of illustration only and are not to be construed as limiting the invention since various changes and modifications within the spirit of the invention will become apparent to those skilled in the art from this detailed description.

In the following examples, unless otherwise specified, all parts and percentages are by weight, all temperatures are in degrees Celsius (°C.), pH was measured at 25° C., and "mass loss" is intended to mean "penetration rate".

EXAMPLE 1

The electrochemical impedance technique was used to estimate corrosion for two mild steel (C1018) electrodes, labeled as Samples A and B. The parameters and results are shown in Table 1 and Table 2.

Steel coupons were fabricated to be used as electrodes in a rotating cylinder electrode apparatus. The apparatus is described in detail in D. C. Silverman, "Rotating Cylinder Electrode for Velocity Sensitivity Testing," in Corrosion, 40 (5), 220–226(1984). The electrochemical impedance technique is described in detail in D. C. Silverman and J. E. Carrico, "Electrochemical Impedance Technique—A Practical Tool for Corrosion Prediction,", in Corrosion, 44(5), 280–287 (1988).

The cylindrical electrode was fabricated from mild steel (C1018). The electrode was sanded with 600 grit silicon carbide paper prior to immersion in the solution to be investigated. Also, the solution was heated to the desired temperature of 90° C. prior to immersing the electrode. The electrode was mounted on a cylindrical shaft, then immersed and set to rotate at 200 rpm in order to guarantee turbulent flow conditions. The water line was at the center of the upper Rulon® [graphite-impregnated poly(tetrafluoroethylene), E.I. du Pont de Nemours & Company] spacer to prevent hydrodynamic end effects from interfering with the results to insure optimal flow and current lines.

In situ data, tabulated in Table 1 (as Sample A) was obtained by exposing the mild steel electrode to a sodium aspartate solution at a pH of 10 in the rotating cylinder apparatus. The pH of the sodium aspartate was approximately 1000 ppm. The temperature was adjusted to 90° C., although the pH was measured at 25° C.

In a similar manner, in situ data, tabulated in Table 2, was obtained for Sample B, except that sodium aspartate was absent and in its stead, the same ionic strength was achieved using sodium sulfate (which has no material effect on corrosion).

Corrosion potentials were measured for the steel electrode employed for each of Sample A and Sample B by measuring the voltage between the steel electrode and a saturated calomel electrode. The electrodes for each of Samples A and B were rotated at various velocities over identical exposure times. The polarization resistances were determined as described in Silverman and Carrico, Ibid. and were used to estimate the corrosion rates which were converted to the penetration rate or mass loss in mils per year (mpy).

Impedance spectra for the steel coupon electrodes (Samples A and B) were generated at a pH of 10 in each of the aqueous solutions employed for Samples A and B and at 200 rpm, using the rotating cylinder electrode apparatus. These spectra (curves) are shown in FIGS. 1, 2, 3, and 4. The agreement between the calculated curve and the actual data demonstrates how well the model used to obtain the polarization resistance agrees with the actual results. The localized nature of the attack noted for the static immersion test under comparable conditions (in Runs 4 and 5 of Example 2, below) was absent on the rotating cylinder electrode. This behavior suggests that the presence of a uniform velocity field advantageously enables the aspartic acid to inhibit corrosion more uniformly. In addition, the increased uniform inhibition suggests that the process is aided by the smoother 600 grit used for the electrode, as compared to the 120 grit finish for the coupons used in the static immersion tests. The net result of the smoother finish is that the surface topography of the electrode was less heterogeneous than that of the static immersion coupons. As such, more uniform velocity and a smoother steel surface decreased the aspartic acid concentration required to inhibit corrosion uniformly on all parts of the surface.

TABLE 1

CORROSION OF MILD STEEL WITH 1000 PPM SODIUM ASPARTATE (pH = 10, ADJUSTED AT 25° C.)

| Exposure Time (hr) | Rotation Rate (rpm) | Polarization Resistance (ohm-cm$^2$) | Estimated Corrosion Rate (mpy) |
|---|---|---|---|
| 0.5 | 200 | 361 | 32.0 |
| 4 | 200 | 4530 | 2.5 |
| 6 | 1000 | 13950 | 0.80 |
| 23 | 200 | 40160 | 0.29 |
| 25 | 1000 | 138300 | 0.09 |
| 47 | 200 | 92340 | 0.13 |
| 49 | 1000 | 2170800 | 0.01 |
| 50 | 200 | 1103800 | 0.02 |

Sample A corrosion potential is −310 mV (S.C.E)

TABLE 2

CORROSION OF MILD STEEL WITH SODIUM HYDROXIDE (pH = 10, adjusted at 25° C.)

| Exposure Time (hr) | Rotation Rate (rpm) | Polarization Resistance (ohm-cm$^2$) | Estimated Corrosion Rate (mpy) |
|---|---|---|---|
| 0.5 | 200 | 256 | 45 |
| 4 | 200 | 296 | 39 |
| 6 | 1000 | 167 | 69 |
| 23 | 200 | 226 | 51 |
| 25 | 1000 | 144 | 80 |
| 47 | 200 | 245 | 47 |
| 49 | 1000 | 241 | 47 |
| 50 | 200 | 289 | 40 |

Sample B corrosion potential is −630 mV (S.C.E.)

As Tables 1 and 2 indicate, the corrosion potential of Sample A with sodium aspartate is −310 mV (S.C.E.), while the corrosion potential of Sample B without sodium aspartate [the conjugate base (in salt form) of aspartic acid]is far more active at −630 mV (S.C.E.). This difference between the corrosion potentials suggests that the sodium aspartate has a greater tendency to oxidize the steel surface.

Nevertheless, the corrosion rates of the respective samples reveal a reverse relationship to this oxidation tendency. The magnitude of the difference between the corrosion rates of Sample A vs. Sample B after identical exposure times demonstrates that the aspartate inhibits corrosion by 100 to 1000 times. Although corrosion began at about the same rate for both Sample A (32 mpy) and Sample B (45 mpy), the rate quickly decreased in the presence of sodium aspartate while it remained very constant in its absence.

Moreover, in the absence of the aspartate, an increase in the rotation rate or fluid velocity resulted in an increase in corrosion rare at least up to 24 hours into the run. After 48 hours, there was no change, most likely because of a corrosion product build-up on the surface. This behavior is normal for carbon steel and water because the reduction of oxygen is the rate limiting step. The rate of mass transfer of oxygen to the corroding surface often determines the corrosion rate, this rate of oxygen transfer can be affected adversely when corrosion products build up on the surface. However, in the presence of the aspartate, the corrosion rare did not increase with the increasing velocity. In fact, there was a significant decrease in corrosion rate with increase in rotation rate consistently throughout the runs. The decrease in corrosion rate, achieved by increasing velocity, seems to be irreversible because even after the rotation rate is subsequently reduced to 200 rpm's as noted from the rates in Table 1 determined at exposure times of 46–48, 49, and 50 hours, the corrosion rate did not return to the 200 rpm 0.13 mpy rate that the sample had prior to increasing the fluid velocity to 1000 rpm.

Accordingly, a sodium salt of aspartic acid, under basic conditions, performs as a corrosion inhibitor for ferrous metals in an unexpected fashion.

The impedance spectra themselves were studied as a function of the rotation rate or fluid velocity using the rotating cylinder electrode over a 48 hour period. Plots at 200 rpm and after 24 hours are shown in FIGS. 1, 2, 3, and 4.

Figure 4:
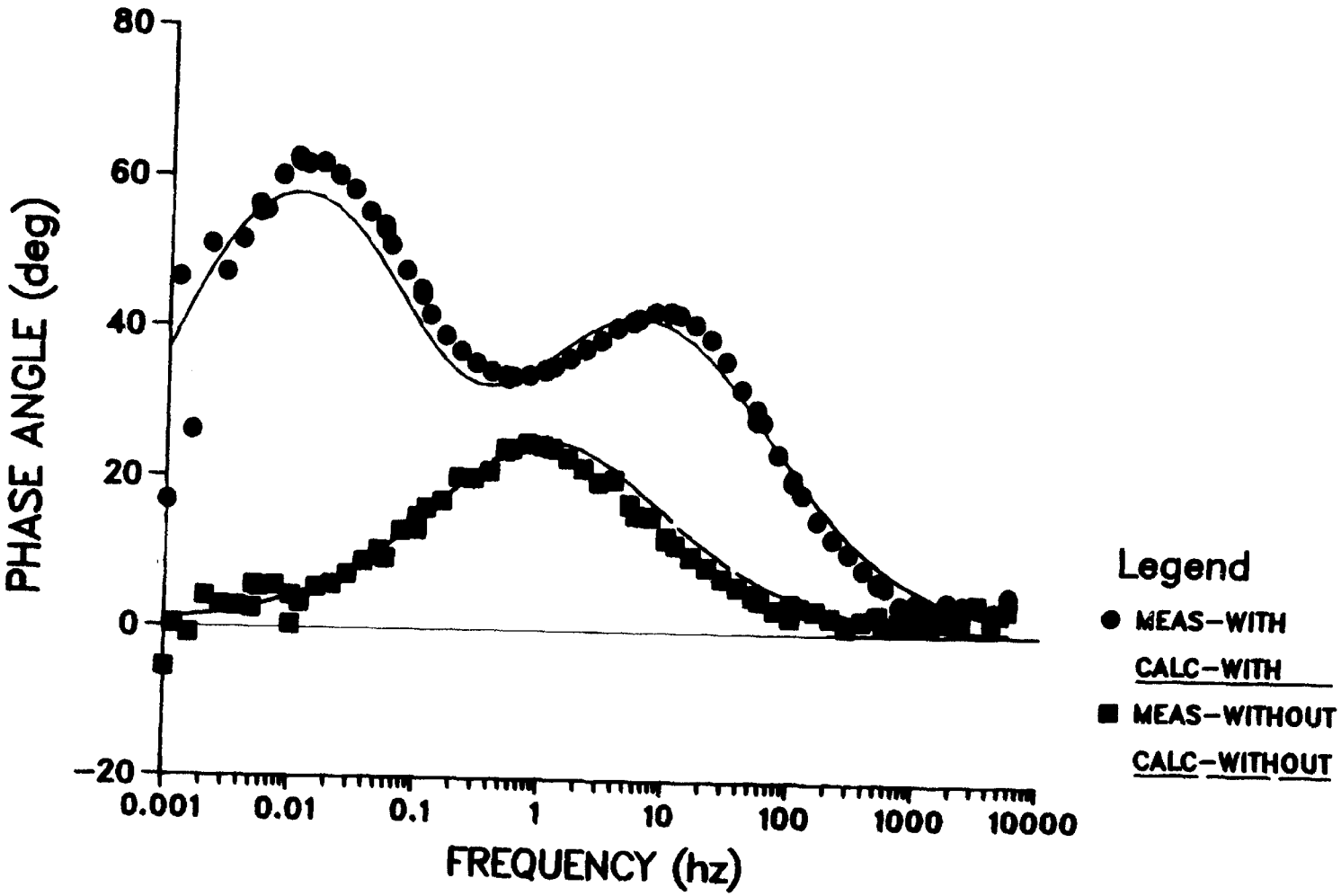
FIG. 4 shows a plot of the phase angle versus logarithm of the frequency for the mild steel electrode in FIGS. 1 and 2.

The peaks exist in the phase angle plots for mild steel in contact with sodium aspartate. This is shown in FIG. 4. Such behavior suggests two relaxation time constants which, in turn, suggests that either a strongly adsorbed intermediate or a tightly adherent film is involved in the corrosion mechanism. The high frequency peak is attributed to the adsorbed intermediate on the film, while the low frequency peak is related to the corrosion rate. Accordingly, while not desiring to be bound by any theory for corrosion mechanism or to limit the present invention in any way, the aspartate ions are believed to form some type of adsorbed layer on the steel surface, even though the mechanism is not completely understood. Further evidence of the presence of some type of adsorbed layer on the steel surface in the presence of aspartate ions is provided by the phase angle plot for mild steel under comparable conditions, but in the absence of aspartate ions. In such plot, which is also shown in FIG. 4, there is only one peak which suggests that only the charge transfer (corrosion) reaction is occurring.

EXAMPLE 2

Fourteen identical mild steel (C1018) coupon specimens were sanded using 120 grit silicon carbide paper, rinsed with deionized water, dried, and weighed. Thereafter, the specimens were subjected to static immersion tests. The parameters and results are reported in Table 3, below. The specimens were hung on glass hooks in glass jars, each containing about 600 $cm^3$ (or cc) of the L-aspartic acid test solution. The solutions were prepared using deionized water and L-aspartic acid in an amount sufficient to provide the desired aspartic acid concentration. The hooks were mounted through rubber stoppers which sealed the tops of the jars. A gas sparger was introduced at the side of the stopper for aeration of the solutions with water-saturated air from which carbon dioxide had been removed. The jars were placed in constant temperature baths in which the temperature was maintained at 90° C. The coupon exposure times were 5 to 7 days, during which time deionized water was periodically added to the aspartic acid test solution to compensate for water loss via evaporation at the elevated temperatures. The pH of each solution was adjusted at the beginning of the test by use of sodium hydroxide and was measured at both room temperature (RT, approximately 25° C.) and at the temperature of the test.

At the conclusion of the coupon exposure times, the coupons were removed from the solutions, cleaned in an ultrasonic bath with soap solution, rinsed with deionized water, rinsed with acetone, dried, and weighed. The coupon surfaces were examined under a stereoscope at between 10× and 30× magnification after exposure. Corrosion rates were estimated in the manner previously explained by measuring the weight change (both before and after exposure to the aspartic acid solution) and then calculating the penetration rate or mass loss in either mpy or grams per hour. In those cases in which corrosion was extremely nonuniform or localized to certain areas on the surface, only the mass loss in grams divided by the total exposure time in hours was reported. The reason is that corrosion rate averaged across the entire surface does not accurately describe the magnitude of corrosion if corrosion occurs in very confined areas. Nevertheless, the results in Table 3 from the static immersion test as compared to the results in Tables 1 and 2 from the constant flowing system, demonstrate that under fairly stagnant flow conditions, there is an increase in the required concentration of aspartic acid needed to accomplish an equivalent level of corrosion inhibition.

TABLE 3

STATIC IMMERSION TEST RESULTS FOR MILD STEEL/ASPARTIC ACID AT 90° C. - AERATED

| Run No. | Concentration (by weight) | pH | Total Mass Loss mpy | $q_t/hr_t$[1] | Comments |
|---|---|---|---|---|---|
| 1 | L-Aspartic Acid 100 ppm | 9.9 @ RT 8.9 @ 90° C. | — | 0.0432/116 | Mixture of attack in localized areas pits, craters, and general corrosion. Large areas of attack. |
| 2 | L-Aspartic Acid 1002 ppm | 8.1 @ Rt 7.3 @ 90° C. | 17.1 | 0.1375/119 | Slight weld attack. Smooth general corrosion. |
| 3 | L-Aspartic Acid 1002 ppm | 8.1 @ RT 7.3 @ 90° C. | >25.0 | 0.2258/138 | General corrosion across entire surface. Some areas of excessive attack. |
| 4 | L-Aspartic Acid 1007 ppm | 10.0 @ RT 9.1 @ 90° C. | — | 0.1859/138 | Local areas of excessive attack. Large areas of no attack. More attack than at 5000 ppm. (See Run 8, below.) |

TABLE 3-continued

STATIC IMMERSION TEST RESULTS FOR MILD STEEL/ASPARTIC ACID AT 90° C. - AERATED

| Run No. | Concentration (by weight) | pH | Total Mass Loss mpy | $q_t/hr_t$[1] | Comments |
|---|---|---|---|---|---|
| 5 | L-Aspartic Acid 1002 ppm | 10.0 @ RT 9.1 @ 90° C. | — | 0.1036/119 | Significant areas of no attack. Several deep craters in localized areas. Anodic inhibitor. (See Runs 11 and 12 below). |
| 6 | L-Aspartic Acid 1000 ppm | 12.0 @ RT 10.8 @ 90° C. | <0.1 | 0.0003/166 | Similar to 3 wt % at pH of 10. Very slight attack/etch at edge in several locations. Otherwise, no attack. Total mass loss under balance detection threshold. |
| 7 | L-Aspartic Acid 1002 ppm | 12.0 @ RT 10.6 @ 90° C. | <0.1 | — | No attack. Mass change within accuracy threshold of balance. |
| 8 | L-Aspartic Acid 5267 ppm | 9.9 @ RT 8.9 @ 90° C. | — | 0.0798/116 | Very shallow pit/stains in scattered locations. Deep penetration near top of coupon where glass holder contacted coupon. Most of mass loss from that area. |
| 9 | L-Aspartic Acid 1.0 wt % | 10.2 @ RT 9.1 @ 90° C. | <0.1 | 0.0003/166 | Very slight etch in one corner. Otherwise, no attack. Toal mass loss under balance detection threshold. |
| 10 | L-Aspartic Acid 3 wt % | 9.5 @ RT 8.3 @ 90° C. | — | 0.4059/166 | Significant general corrosion across entire surface. Weld attack. One deep pit in weld. |
| 11 | L-Aspartic Acid 3.05 wt % | 10.2 @ RT 9.1 @ 90° C. | <0.1 | 0.0001/116 | Very slight attack/stain at edge in several locations. Otherwise, no attack. Total mass loss under balance detection threshold. |
| 12 | L-Aspartic Acid 3.0 wt % | 10.2 @ RT 9.2 @ 90° C. | <0.1 | 0.0000/116 | No attack. Mass loss under balance detection threshold. |
| 13 | L-Aspartic Acid 3.0 wt % | 11.1 @ RT 10.1 @ 90° C. | <0.1 | 0.0001/138 | No attack except for one pit-like structure which could be an imperfection in surface. Total mass loss under balance detection threshold. |
| 14 | L-Aspartic Acid 3.0 wt % | 13.1 @ RT 11.6 @ 90° C. | <0.1 | 0.0008/166 | Very slight etch in neutral locations. |

[1]Total grams per total hours exposure time.

EXAMPLE 3

The procedure described in Example 2 was employed, except that the solutions did not contain aspartic acid and only three steel coupons were subjected to the static immersion test. The solutions were adjusted to have the same conductivity as those containing aspartic acid by the addition of sodium sulfate, thereby limiting the corrosion to that created solely by oxygen contained in the water at the designated pH. The results are set forth in Table 4.

TABLE 4

STATIC IMMERSION TEST RESULTS FOR MILD STEEL WITHOUT INHIBITOR AT 90° C.

| Run No. | pH | Total mpy | Mass Loss $g_t/hr_t$ | Comments |
|---|---|---|---|---|
| 1 | 8.0 @ RT 7.1 @ 90° C. | 12.4 | 0.0987/119 | Severe general corrosion across entire surface. |
| 2 | 10.0 @ RT 8.7 @ 90° C. | 21.4 | 0.1725/119 | Severe general corrosion across entire surface. |
| 3 | 12.0 @ RT 10.4 @ 90° C. | 0.30 | 0.0024/119 | Some stains which have appearance of pitting initiation sites. |

[1]Total grams per total hours exposure time.

At a pH of 8, the corrosion rate is higher in the presence of aspartic acid than in its absence when the results of Runs 2 and 3 from Table 3 are compared to those of Run 1 from Table 4. This tends to confirm that at a pH of 8 there is no beneficial corrosion inhibition from aspartic acid; instead, it behaves as a corrosion accelerator. The same behavior is found at a pH of 9.5 and a concentration of 3 weight percent aspartic acid (Run 10 of Table 3). Such behavior is attributed to the fact that at a pH of 9.5 or less, the aspartic acid does not exist in the completely or fully ionized (conjugate base) form. This is clearly evidenced by an observed change in behavior at a pH higher than 9.5, for example, at a pH of 10 and higher, even at levels of aspartic acid as low as 1000 ppm. Virtually all corrosion disappears under the static test conditions of Table 3 at concentrations of 1 weight percent at a pH of 10 (Run 9). Thus, at pH values between 8.5 and about 9.0, as measured at 90° C., or at a pH of 10 or higher at room temperature (approximately 25° C.) aspartic acid, under static conditions, inhibits corrosion whereas it increases or accelerates corrosion at a lower pH.

The fact that some attack or corrosion is noted at concentrations of 1000 ppm (Runs 4 and 5) and 5000 ppm (Run 8) at pH of 9.9 to 10 does not mean that the aspartic acid does not inhibit corrosion at those concentrations. The large areas of no attacks strongly suggest that aspartic acid is indeed inhibiting corrosion. This apparent inconsistency results from the inability of the aspartic acid to be distributed uniformly on the steel coupon under the stagnant flow or static conditions in the immersion test runs.

EXAMPLE 4

Steel coupons were fabricated to be used as electrodes in the rotating cylinder electrode apparatus described in Example 1 at three different pH levels (8, 10, and 12) for aspartic acid solutions containing 1000 ppm aspartic acid. A fourth coupon was subjected to the same procedure (for comparison purposes) at a pH of 10, except that aspartic acid was omitted and the solution was adjusted with sodium sulfate to have the same conductivity as if aspartic acid were present. Corrosion was estimated using the electrochemical impedance technique described in Example 1. The results are shown in Table 5.

Electrochemical impedance spectra were generated to 0.01 hertz (hz) after about 30 minutes to obtain an estimate of the corrosion rate at short exposure. Thereafter, spectra were generated to 0.001 hz at 200 rpm each day. In addition, spectra were generated to 0.01 hz at 1000 rpm to obtain estimates of the effect of fluid velocity on corrosion. Experiments were run at pH values of 8, 10, and 12 with 1000 ppm of aspartic acid and at a pH of 10 in the absence of aspartic acid. The amplitude of perturbing voltage signal was small (5 mV) to insure that linearity existed between perturbation and response.

The steel electrodes were weighed both before and after the experiment. The mass loss was used to make an additional estimate of the corrosion rate. Note that at a pH of 10 and especially 12, the mass losses were affected by water seepage behind the electrode. The polarization resistances were estimated using the circuit analogues shown FIG. 2 of Silverman and Carrico, Ibid.

The results of the rotating cylinder electrode experiments show that under ideal conditions of fluid velocity, aspartic acid concentrations at least as low as 1000 ppm can decrease the corrosion rate to the order of 0.1 to 0.5 mpy from the 50 to 100 mpy exhibited in its absence (at a pH of 10). In the absence of aspartic acid, fluid motion increases corrosion until the surface becomes so corroded that the velocity profile is affected near the surface. This dependence is expected for corrosion of mild steel and low alloy steels in water. However, in the presence of aspartic acid at a pH above 9.5 (measured at room temperature), corrosion is decreased by fluid motion.

TABLE 5

ELECTROCHEMICAL IMPEDANCE RESULTS EOR MILD STEEL AT 90° C.

| Exposure Time | Rotation Rate (rpm) | Polarization Resistance (ohm-cm$^2$) | Corrosion Rate (mpy) Electrochemical Mass Impedance | Loss |
|---|---|---|---|---|
| | | Aspartic Acid Solution - 1000 ppm pH = 8 @ 25° C. | | |
| 0.5 | 200 | 271 | 84 | |
| 1 | 200 | 323 | 71 | |
| 3–5 | 200 | 204 | 112 | 90 |
| 20–22 | 200 | 200 | 114 | |
| 23 | 1000 | 128 | 179 | |
| 24 | 200 | 196 | 117 | |
| | | pH = 10 @ 25° C. | | |
| 0.5 | 200 | — | | |
| 3–5 | 200 | 4180 | 5.5 | |
| 21–23 | 200 | 13780 | 1.7 | |
| 24 | 1000 | 68260 | 0.33 | |
| 25 | 200 | 25000 | 0.91 | 2.7 |
| 55 | 200 | 39590 | 0.58 | |
| 117–119 | 200 | 36780 | 0.62 | |
| 120 | 1000 | 41980 | 0.54 | |

TABLE 5-continued

ELECTROCHEMICAL IMPEDANCE RESULTS EOR MILD STEEL AT 90° C.

| Exposure Time | Rotation Rate (rpm) | Polarization Resistance (ohm-cm$^2$) | Corrosion Rate (mpy) Electrochemical Mass Impedance | Loss |
|---|---|---|---|---|
| | | pH = 12 @ 25° C. | | |
| 0.5 | 200 | 32280 | 0.71 | |
| 3–5 | 200 | 35230 | 0.65 | Water |
| 22–24 | 200 | 39790 | 0.57 | Seepage |
| 25 | 1000 | 39800 | 0.57 | Behind |
| 26 | 200 | 32580 | 0.71 | Electrode |
| 45–47 | 200 | 133950 | 0.20 | Spacer |
| 48 | 1000 | 278000 | 0.080 | |
| 49 | 200 | 120000 | 0.19 | |
| | | No Aspartic Acid pH = 10 @ 25° C. | | |
| .05 | 200 | 256 | 89 | |
| 3–5 | 200 | 296 | 77 | |
| 22–24 | 1000 | 167 | 137 | |
| 25 | 200 | 226 | 101 | 57 |
| 26 | 1000 | 143 | 160 | |
| 45–47 | 200 | 245 | 93 | |
| 48 | 1000 | 241 | 95 | |
| 49 | 200 | 288 | 79 | |

EXAMPLE 5

This Example demonstrates that a precorroded surface can be protected by the corrosion inhibitors of the present invention. The results show in Table 6 were determined by exposing a steel cylinder electrode precorroded in deionized water in the rotating cylinder electrode apparatus described in Example 1 with 2000 ppm of sodium sulfate (to have about the same conductivity as 1000 ppm aspartic acid at a pH of 10) and 50 ppm of sodium chloride. In 24 hours, the electrode suffered a significant mass loss and had a red-brown rust layer. This electrode was placed in an aqueous solution having an aspartic acid concentration of 5000 ppm and adjusted to a pH of about 10 with sodium hydroxide and held under constant rotation. The polarization resistance quickly increased over 24 hours, indicating that the corrosion rate decreased with exposure time. The corrosion rate never decreased to the value of an electrode not precorroded and exposed to 1000 ppm aspartic acid. Compare, for example, the results show in Table 1. This difference indicates that the concentration was not optimized for this particular system. Of greater significance, however, is the observation that even 1000 ppm aspartic acid can inhibit corrosion of steel, even precorroded steel, under the proper conditions.

TABLE 6

ELECTROCHEMICAL IMPEDANCE FOR MILD STEEL IN ASPARTIC ACID AT 90° C.: EFFECT OF PRE-CORROSION ON CORROSION INHIBITION PROPERTIES

| Exposure Time | Rotation Rate (rpm) | Polarization (ohm-cm$^2$) | Corrosion Rate by Mass Loss(mpy) |
|---|---|---|---|
| Pre-Corroded in Water at pH = 5.75, 90° C. | | | |
| 5–7 | 200 | 242 | 71 |
| 17–19 | 200 | 87 | (81 mpy by |
| 21 | 1000 | 182 | (impedance) |
| Immersed Electrode in 5000 nm Aspartic Acid (pH = 9.91 @ 25° C. | | | |
| 0.5 | 200 | 610 | |
| 4–6 | 200 | 1520 | |
| 19–21 | 200 | 2980 | |

TABLE 6-continued

ELECTROCHEMICAL IMPEDANCE FOR MILD STEEL IN ASPARTIC ACID AT 90° C.: EFFECT OF PRE-CORROSION ON CORROSION INHIBITION PROPERTIES

| Exposure Time | Rotation Rate (rpm) | Polarization (ohm-cm$^2$) | Corrosion Rate by Mass Loss(mpy) |
|---|---|---|---|
| 22 | 1000 | 5400 | Not |
| 24 | 2000 | 19000 | Determined |
| 42–44 | 200 | 6020 | |
| 45 | 1000 | >10000 | |

EXAMPLE 6

Static immersion tests were conducted as described in Example 2, except that glutamic acid, glycine, and certain acids commonly used in anti-freeze formulations were employed in place of the aspartic acid. The parameters and results are shown in Table 7. As you can see, glutamic acid and glycine, respectively, show behavior and corrosion inhibition similar to the aspartic acid. While slightly more staining of the coupon was observed, the mass loss was similar to that with aspartic acid at the same pH. In addition, these results reveal that aspartic acid behaves comparably to that of a mixture of benzoic acid, sebacic acid, and octanoic acid at 90° C. Because acids such as the latter-named acids are commonly used in anti-freeze formulations, the results for aspartic acid (Runs 11 and 12 in Table 3 of Example 2) indicate that aspartic acid may be employed as a suitable substitute for such acids. The ammonium salt of aspartic acid, as can be seen from Table 7, does not appear to function as well as the sodium salt because the pH decreased to 7.7, a pH below the point at which aspartic acid (as the conjugate base) can exist in the fully ionized form.

TABLE 7

STATIC IMMERSION TEST RESULTS FOR MILD STEEL/ASPARTIC ACID AT 90° C. - AERATED

| Run No. | Concentration (by weight) | pH | Total Mass Loss mpy | $q_t/hr_t$[1] | Comments |
|---|---|---|---|---|---|
| 1 | Glumatic Acid 1100 ppm | 8.1 @ RT 7.3 @ 90° C. | 18.4 | 0.1685/138 | Surface blackended. General corrosion across entire corrosion surface. Some uneven attack. |
| 2 | Glumatic Acid 1100 ppm | 8.1 @ Rt 7.4 1E 90° C. | 15.4 | 0.1223/119 | Surface blackended. General corrosion across entire surface. |
| 3 | Glumatic Acid 1100 ppm | 10.2 @ RT 9.4 @ 90° C. | — | 0.0325/138 | Several areas of extreme localized corrosion near edge, in stencil, and near hole. Large area of no attack. |
| 4 | Glumatic Acid 1100 ppm | 10.2 @ RT 9.4 @ 90° C. | — | 0.0220 g/119 | One area of very deep cratering. Large areas of no attack. |
| 5 | Glumatic Acid 1100 ppm | 12.0 @ RT 10.8 @ 90° C. | <0.1 | 0.0000/138 | No attack except for stains near edge. Mass loss less than balance threshold. |
| 6 | Glumatic Acid 1100 ppm | 12.0 @ RT 10.8 @ 90° C. | <0.1 | 0.0001/119 | No attack. Mass loss less than balance threshold. |
| 7 | Glumatic Acid 3 wt % | 10.0 @ RT 8.9 @ 90° C. | <0.1 | 0.0002/143 | Circular stains suggesting etch. Could be pits trying to initiate or be extinguished. Otherwise, no attack. |
| 8 | Glycine 1000 ppm | 10.0 @ RT 8.5 @ 90° C. | — | 0.0035/143 | Significant attack near hole. Scattered light general attack in localized areas. Large areas of no attack. |
| 9 | Glycine 3 wt % | 10.0 @ RT 8.7 @ 90° C. | <0.1 | 0.0006/143 | No attack. Mass loss less than balance threshold. |
| 10 | Benzoic Acid Sabacic Acid Octanoic Acid Each at 1 wt % | 10.0 @ RT 8.6 @ 90° C. | <0.1 | 0.0002/143 | Possible circular stains. Stains along one edge near the top. Mass loss less than balance threshold. |
| 11 | L-Aspartic Ammonium salt 3 wt % | 9.5 @ RT 7.7 @ 90° C. | <200.0 | 2.4436.166 | Severe attack. Preferential attack of bulk alloy, not weld. General corrosion. |

[1]Total grams per total hours exposure time.

EXAMPLE 7

Static immersion tests were conducted as described in Example 2, except that polyaspartic acid at concentration from between 2000 ppm to 3.3 percent and polyaspartyl hydroxamic acid (to show the effects of the absence of the amino group of the amino acid) at 90° C. were employed in place of aspartic acid. The parameters and results are shown in Table 8. The 2000 ppm concentration was chosen so that the carboxyl concentration would be similar to that of aspartic acid at 1000 ppm. Corrosion inhibition was found for pH values of 9.5 and higher when measured at 25° C. (which converts to a pH of about 8.4 at 90° C.). This is very similar to the pH threshold for aspartic acid, and would suggest that higher loading of polyaspartic might be required for total inhibition on all surface sites to occur on heterogeneous surfaces, though a significant degree of inhibition was observed at 2000 ppm. It is anticipated, however, that under higher fluid velocity such as that used with the rotating electrode, the corrosion inhibition properties of polyaspartic acid would increase.

Polyaspartyl hydroxamic acid, which does not contain an amino group, showed poorer inhibition at the same concentration as aspartic acid.

TABLE 8

STATIC IMMERSION TEST RESULTS FOR MILD STEEL/ASPARTIC ACID AT 90° C.

| Run No. | Concentration (by weight) | pH | Total Mass Loss mpy | Total Mass Loss $q_T/hr_T$[1] | Comments |
|---|---|---|---|---|---|
| 1 | Polyaspartic[2] 2000 ppm | 10.3 @ RT 6.7 @ 90° C. | — | 0.005/153 | Some very shallow pits. 1 wide, shallow crater. Large areas of no attack. Mass loss less than balance threshold. |
| 2 | Polyaspartic[2] 3 wt % | 8.0 @ Rt 6.5 @ 90° C. | 150 | 1.4352/143 | Severe general attack almost uniform across entire surface. Weld attacked less than base metal. |
| 3 | Polyaspartic[2] 3 wt % | 10.1 @ RT 8.4 @ 90° C. | — | 0.0081/143 | Slight etch in various locations. darkened area where glass hook touched the coupon. Several darkened circles. |
| 4 | Polyaspartic[2] 3.3 wt % | 9.6 @ RT 8.4 @ 90° C. | — | 0.0009/143 | One area of slight attack along a scratch in coupon. One area of very slight general uniform corrosion. Large area of no attack. |
| 5 | Polyaspartyl Hydroxamic Acid 3 wt % | 10.0 @ RT 8.7 @ 90° C. | >4 | 0.0370/143 | Deposits on surface not removable. Much pitting along sanding marks. More attack than polyaspartic under same conditions. |

[1]Total grams per total hours exposure time.

EXAMPLE 8

This Example demonstrates that the compositions of the present inventions are effective as corrosion inhibitors at relatively low temperatures.

Static immersion tests for steel in water at a pH of 10 with no inhibitor, 3% aspartic acid, or 3% polyaspartic acid at 30° C. were conducted as described in Example 2. The parameters and results are shown in Table 9. Both the aspartic acid and the polyaspartic acid imparted significant corrosion inhibition under these relatively low temperature conditions (10.0 mpy decreased to less than 0.1 mpy with no localized corrosion).

TABLE 9

STATIC IMMERSION TEST RESULTS FOR MILD STEEL/POLYASPARTIC ACID AT 30° C.

| Run No. | Concentration (by weight) | pH | Total Mass Loss mpy | $q_t/hr_t$[1] | Comments |
|---|---|---|---|---|---|
| 1 | No Inhibitor | 10.0 | 10.0 | 0.1146/164 | Smooth, general corrosion. Darkening where rod held coupon. Weld etch. |
| 2 | L-Aspartic Acid - 3 wt % | 10.3 | <0.1 | 0.0006/164 | No attack. Mass loss less than balance threshold. |
| 3 | Polyaspartic Acid - 3 wt % | 10.1 | <0.1 | 0.0002/164 | No attack. Mass loss less than balance threshold. |

[1]Total grams per total hours exposure time.

Thus, it is apparent that there has been provided, in accordance with the present invention, compositions and a process for inhibiting corrosion of ferrous metals in the presence of an aqueous medium that fully satisfy the objects and advantages set forth hereinabove. While the invention has been described with respect to various specific examples and embodiments thereof, it is understood that the invention is not limited thereto and many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. A composition for inhibiting corrosion of ferrous metals in the presence of an aqueous medium, which composition comprises:

(a) an amino acid in its fully ionized conjugate base state, the amino acid being represented by the formula

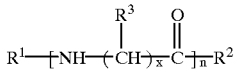

wherein $R^1$ represents

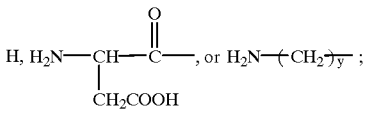

$R^2$ represents

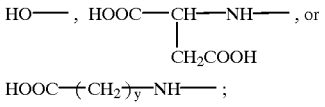

$R^3$ represents H or —COOH;

x and y each independently represents an integer from 1 to 3; and n represents an integer from 1 to 850 for the number of repeating aminoacyl units, in an amount effective to inhibit corrosion of the ferrous metal, and (b) a base in an amount effective to provide the amino acid in a fully ionized form under use conditions, wherein the pH is about ten and above.

2. The composition of claim 1 wherein the amino acid is selected from the group consisting of aspartic acid, polyaspartic acid, and salts thereof.

3. The composition of claim 1 wherein the amino acid is present in an amount sufficient to provide an amino acid concentration in the aqueous medium under use conditions of from about 1000 ppm to about 5.0 weight percent and higher.

4. The composition of claim 3 wherein the amino acid is present in an amount sufficient to provide an amino acid concentration in the aqueous medium under use conditions of from about 1000 ppm to about 3.3 weight percent.

5. The composition of claim 3 wherein the amino acid is aspartic acid and salts thereof and n is 1.

6. The composition of claim 5 wherein the pH of the aqueous medium is adjusted by the addition thereto of base.

7. The composition of claim 4 wherein the amino acid is polyaspartic acid and salts thereof.

8. The composition of claim 1 wherein the pH in the aqueous medium under use conditions is from about 10 to about 14.

9. The composition of claim 8 wherein the pH in the aqueous medium, when measured at room temperature, is from about 10 to about 14.

10. The composition of claim 9 wherein the pH in the aqueous medium, when measured at room temperature, is from about 10 to about 11.

11. The composition of claim 1 wherein the base is selected from the group consisting of alkali metal hydroxides, alkali metal carbonates, alkaline earth metal hydroxides, ammonium hydroxides, and hydrocarbylamines.

12. The composition of claim 11 wherein the base is an alkali metal hydroxide.

13. The composition of claim 12 wherein the alkali metal hydroxide is selected from the group consisting of sodium hydroxide and potassium hydroxide.

14. The composition of claim 1 wherein the amino acid is selected from the group consisting of polyaspartic acid and salts thereof.

15. The composition of claim 1 wherein the pH of the aqueous medium is adjusted by the addition thereto of base.

16. The composition of claim 15 wherein the base is selected from the group consisting of alkali metal hydroxides, alkali metal carbonates, alkaline earth metal hydroxides, ammonium hydroxides, and hydrocarbylamines.

17. The composition of claim 16 wherein the base is an alkali metal hydroxide.

18. The composition of claim 17 wherein the alkali metal hydroxide is selected from the group consisting of sodium hydroxide and potassium hydroxide.

* * * * *

UNITED STATES PATENT AND TRADEMARK OFFICE

CERTIFICATE OF CORRECTION

PATENT NO. : 6,200,499 B1
DATED : March 13, 2001
INVENTOR(S) : Kalota et al.

It is certified that error appears in the above-identified patent and that said Letters Patent is hereby corrected as shown below:

Column 4,
Line 6, replace the "10,2000" with "10,200".

Column 5,
Line 29, thereof, please replace "poly aspartic" with "polyaspartic" and the word "present" with "presence".

Column 9,
Line 6, replace the term "rare" with "rate".

Table 3,
Run No. 11, replace "10.2" with "10.0".

Table 5,
Replace the column heading "Corrosion Rate (mpy)" with "Corrosion Rate (mpy)" and replace the column heading "Electrochemical Mass" with Electrochemical Mass".

Column 15,
Line 14, add the term "(hr)" immediately after the word "Time".
Line 24, replace "nm" with "ppm".

Column 16,
Line 19, replace the phrase "you can see" with the phrase "can be seen".

Table 7,
In Run No. 1, replace the term "blackended" with the term "blackened".
In Run No. 2, replace the term "blackended" with the term "blackened".
Run No. 2, replace "1E" with "@".

Column 17,
Line 4, replace the word "concentration" with the word "concentrations".

UNITED STATES PATENT AND TRADEMARK OFFICE

CERTIFICATE OF CORRECTION

PATENT NO. : 6,200,499 B1
DATED : March 13, 2001
INVENTOR(S) : Kalota et al.

It is certified that error appears in the above-identified patent and that said Letters Patent is hereby corrected as shown below:

Table 8,
Run No. 1, replace "0.005/153" with "0.0005/143".
Run No. 1, replace "6.7" with "8.7".

Column 20,
Line 20, replace "1000" with "100".

Signed and Sealed this

Thirtieth Day of October, 2001

*Attest:*

Nicholas P. Godici

NICHOLAS P. GODICI
*Acting Director of the United States Patent and Trademark Office*

*Attesting Officer*